US007050972B2

(12) United States Patent
Henn et al.

(10) Patent No.: US 7,050,972 B2
(45) Date of Patent: May 23, 2006

(54) ENHANCING THE PERFORMANCE OF CODING SYSTEMS THAT USE HIGH FREQUENCY RECONSTRUCTION METHODS

(75) Inventors: Fredrik Henn, Bromma (SE); Andrea Ehret, Nürnberg (DE); Michael Schug, Erlangen (DE)

(73) Assignee: Coding Technologies AB, Stockholm (SE)

( * ) Notice: Subject to any disclaimer, the term of this patent is extended or adjusted under 35 U.S.C. 154(b) by 599 days.

(21) Appl. No.: 09/987,657

(22) Filed: Nov. 15, 2001

(65) Prior Publication Data

US 2002/0103637 A1 Aug. 1, 2002

(30) Foreign Application Priority Data

Nov. 15, 2000 (SE) ..... 0004187

(51) Int. Cl.
*G10L 21/02* (2006.01)

(52) U.S. Cl. ..... 704/228; 704/233; 704/230; 704/229

(58) Field of Classification Search ..... 704/206, 704/201, 200.1, 219, 208, 226–233, 214, 704/273

See application file for complete search history.

(56) References Cited

U.S. PATENT DOCUMENTS 4,158,751 A * 6/1979 Bode ..... 704/208
4,896,362 A * 1/1990 Veldhuis et al. ..... 704/200.1
5,285,498 A * 2/1994 Johnston ..... 704/200.1
5,404,377 A * 4/1995 Moses ..... 704/200.1
5,646,961 A * 7/1997 Shoham et al. ..... 704/227
5,928,342 A * 7/1999 Rossum et al. ..... 704/201
6,385,548 B1 * 5/2002 Ananthaiyer et al. ..... 704/214
6,424,939 B1 * 7/2002 Herre et al. ..... 704/219
6,490,562 B1 * 12/2002 Kamai et al. ..... 704/258
6,757,395 B1 * 6/2004 Fang et al. ..... 704/226
2002/0116197 A1 * 8/2002 Erten ..... 704/273

FOREIGN PATENT DOCUMENTS

WO WO 98/57436 A2 12/1998

OTHER PUBLICATIONS

Taniguchi et al ("A High-Efficiency Speech Coding Algorithm based on ADPCM with Multi-Quantizer", International Conference on Acoustics, Speech, and Signal Processing, Apr. 1986).*

(Continued)

*Primary Examiner*—Vijay B. Chawan
(74) *Attorney, Agent, or Firm*—Birch, Stewart, Kolasch & Birch, LLP

(57) ABSTRACT

An apparatus for encoding an audio signal to obtain an encoded audio signal to be used by a decoder having a high frequency reconstruction module for performing a high frequency reconstruction for a frequency range above a crossover frequency includes, a core encoder for encoding a lower frequency band of the audio signal up to the crossover frequency, the crossover frequency being variable, and the core encoder being operable on a block-wise frame by frame basis, and a crossover frequency control module for estimating, dependent on a measure of the degree of difficulty for encoding the audio signal by the core encoder and/or a boarder between a tonal and a noise-like frequency range of the audio signal, the crossover frequency to be selected by the core encoder for a frame of a series of subsequent frames, so that the crossover frequency is variable adaptively over time for the series of subsequent frames.

9 Claims, 4 Drawing Sheets

OTHER PUBLICATIONS

Hollier ("Error Activity And Error Entropy As A Measure Of Psychoacoustic Significance In The Perceptual Domain", IEE Proceedings—Vision, Image and Signal Processing, Jun. 1994).*

Vinay et al ("Context-Based Error Recovery Technique for GSM AMR Speech Codec", International Conference on Acoustics, Speech, and Signal Processing, May 2002).*

Taniguchi, T. et al., A High-Efficiency Speech Coding Algorithm based on ADPCM with Multi-Quantizer, ICASSP 86 Proceedings, Apr. 7-11, 1986, pp. 1721-1724, vol. 3 of 4, Japan.

Paulus, J., 16 KBIT/S Wideband Speech Coding Based on Unequal Subbands, 1996 IEEE International Conference on Acoustics, Speech, and Signal Processing, 1996, pp. 255-258, vol. 1.

Zemouri, R. et al., Design of a Sub-Band Coder for Low-Bit Rate Using Fixed and Variable Band Coding Schemes, 20th Internatiional Conference on Industrial Electronics, Control and Instrumentation, 1994, IECON '94, pp. 1901-1906, vol. 3.

Schnitzler J., A 13.0 KBIT/S Wideband Speech Codec Based on SB-ACELP, Proceedings of the 1998 International Conference on Acoustics, Speech and Signal Processing, 1998, pp. 157-160, vol. 1.

AAC-Standard, ISO/IEC 13818-7;1997 (E), pp. 95-126.

Zwicker, E. et al., Psychoacoustics—Facts and Models, 1990, pp. 204-207 & 316-319, Springer-Verlag, Berlin.

* cited by examiner

PRIOR ART

ENHANCING THE PERFORMANCE OF CODING SYSTEMS THAT USE HIGH FREQUENCY RECONSTRUCTION METHODS

BACKGROUND OF THE INVENTION

1. Field of the Invention

The present invention relates to digital audio coding systems that employ high frequency reconstruction (HFR) methods. It enables a more consistent core codec performance, and improved audio quality of the combined core codec and HFR system is achieved.

2. Description of Related Art

Audio source coding techniques can be divided into two classes: natural audio coding and speech coding. Natural audio coding is commonly used for music or arbitrary signals at medium bit rates. Speech codecs are basically limited to speech reproduction, but can on the other hand be used at very low bit rates. In both classes, the signal is generally separated into two major signal components, a spectral envelope and a corresponding residual signal. Codecs that make use of such a division exploit the fact that the spectral envelope can be coded much more efficiently than the residual. In systems where high-frequency reconstruction methods are used, no residual corresponding to the highband is transmitted. Instead, a highband is generated at the decoder side from the lowband covered by the core codec, and shaped to obtain the desired highband spectral envelope. In double-ended HFR systems, envelope data corresponding to the upper frequency range is transmitted, whereas in single-ended HFR systems the highband envelope is derived from the lowband. In either case, prior art audio codecs apply a time invariant crossover frequency between the core codec frequency range and the HER frequency range. Thus, at a given bit rate, the crossover frequency is selected such that a good trade-off between core codec introduced artifacts, and HER system introduced artifacts is achieved for typical program material. Clearly, such a static setting may be far from the optimum for a particular signal. The core codec is either overstressed, resulting in higher than necessary lowband artifacts, which inherent to the HER method also degrades the highband quality, or not used to its full potential, i.e., a larger than necessary HER frequency range is employed. Hence, the maximum performance of the joint coding system is only occasionally reached by prior art systems. Furthermore, the possibility to align the crossover to transitions between regions with disparate spectral properties, such as tonal and noise like regions, is not exploited.

SUMMARY OF THE INVENTION

The present invention provides a new method and an apparatus for improvement of coding systems where high frequency reconstruction methods (HFR) are used. The invention parts from the traditional usage of a fixed crossover frequency between the lowband, where conventional coding schemes (such as MPEG Layer-3 or AAC) are used, and the highband, where HFR coding schemes are used, by continuous estimation and application of the crossover frequency that yields the optimum tradeoff between artifacts introduced by the lowband codec and the HFR system respectively. According to the invention, the choice can be based on a measure of the degree of difficulty of encoding a signal with the core codec, a short-time bit demand detection, and a spectral tonality analysis, or any combination thereof. The measure of difficulty can be derived from the perceptual entropy, or the psychoacoustically relevant core codec distortion. Since the optimum choice changes frequently over time, the application of a variable crossover frequency results in a substantially improved audio quality, which also is less dependent on program material characteristics. The invention is applicable to single-ended and double-ended HFR-systems.

BRIEF DESCRIPTION OF THE DRAWINGS

The present invention will now be described by way of illustrative examples, not limiting the scope or spirit of the invention, with reference to the accompanying drawings, in which.

DETAILED DESCRIPTION OF THE PRESENT INVENTION

The below-described embodiments are merely illustrative for the principles of the present invention. It is understood that modifications and variations of the arrangements and the details described herein will be apparent to others skilled in the art. It is the intent, therefore, to be limited only by the scope of the impending patent claims and not by the specific details presented by way of description and explanation of the embodiments herein.

Figure 1:
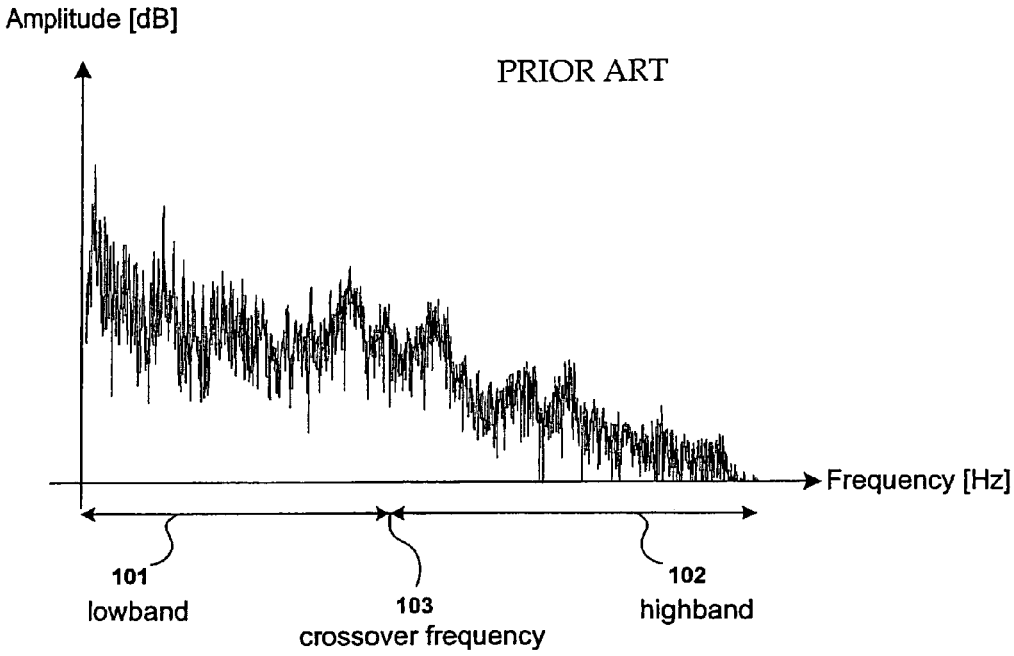
FIG. 1 is a graph that illustrates the terms lowband, highband and crossover frequency.

In a system where the lowband or low frequency range, 101 as given in FIG. 1, is encoded by a core codec and the highband or high frequency range, 102, is covered by a suitable HFR method, the border between the two ranges can be defined as the crossover frequency, 103. Since the encoding schemes operate on a block-wise frame by frame basis, one is free to change the crossover frequency for every processed frame. According to the present invention, it is possible to sot up a detection algorithm that adapts the crossover frequency such that the optimum quality for the combined coding system is achieved. The implementation thereof is hereinafter referred to as the crossover frequency control module.

Taking into account that the audio quality of the core codec is also the basis for the quality of the reconstructed highband, it is obvious that a good and constant audio quality in the lowband range is desired. By lowering the crossover frequency, the frequency range that the core codec has to cope with is smaller, and thus casier to encode. Thus, by measuring the degree of difficulty of encoding a frame and adjusting the crossover frequency accordingly, a more constant audio quality of the core encoder can be achieved.

As an example on how to measure the degree of difficulty, the perceptual entropy [ISO/IEC 13818-7, Annex B.2.1] may be used: Here a psychoacoustic model based on a spectral analysis is applied. Usually the spectral lines of the analysis filter bank are grouped into bands, where the number of lines within a band depends on the band center-frequency and is chosen according to the well-known bark scale, aiming at a perceptually constant frequency resolution for all bands. By using a psychoacoustic model that exploits effects such as spectral or temporal masking, thresholds of audibility for every band is obtained. The perceptual entropy within a band is then given by $$e(b) = \frac{1}{2}\sum_{i=0}^{L(b)-1} \log_2(r(i)) + l \quad \text{(Eq. 1)}$$

where $$r(i) = s(i)^2 \frac{L(b)}{t(b)}$$

and i=spectral line index within current band
s(i)=spectral value of line i
L(b)=number of lines in current band
t(b)=psychoacoustic threshold for current band
b=band index
l=number of lines in current band such that r(i)>1.0 and only terms such that r(i)>1.0 are used in the summation.

By summing up the perceptual entropies of all bands that have to be coded in the low band frequency range, a measure of the encoding difficulty for the current frame is obtained.

A similar approach is to calculate the distortion energy at the end of the core codec encoding process by summing up the distortion energy of every band according to $$n_{tot} = \sum_{b=0}^{B-1} n(b) \quad \text{(Eq. 2)}$$

where $$n(b) = \begin{cases} n_q(b) - t(b) & \text{for } n_q(b)/t(b) > 1.0 \\ 0 & \text{otherwise} \end{cases}$$

and $n_q(b)$=quantization noise energy
t(b)=psychoacoustic threshold
b=band index
B=number of bands Furthermore, the distortion energy may be weighted by a loudness curve, in order to weight the actual distortion to its psychoacoustic relevance. As an example, the summation in Eq. 2 can be modified to $$n'_{tot} = \sum_{b=0}^{B-1} (n(b))^{0.23} \quad \text{(Eq. 3)}$$

where a simplification of a loudness function according to Zwicker is used ["Psychoacoustics", Eberhard Zwicker and Hugo Fastl, Springer-Verlag, Berlin 1990].

Figure 2:
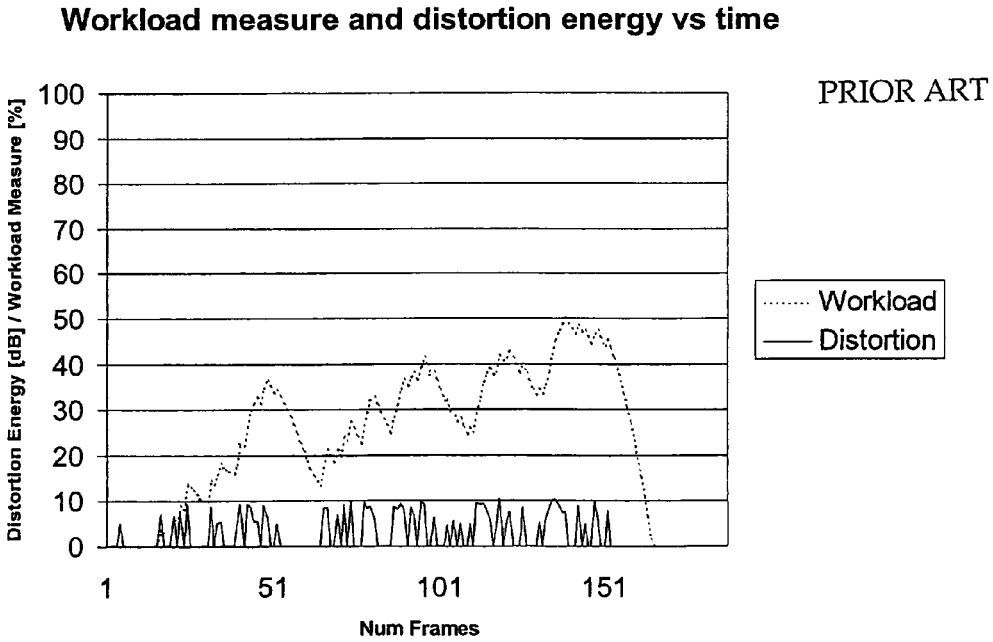
FIG. 2 is a graph that illustrates a core codec workload measure.

An encoding difficulty or workload measure can then be defined as a function of the total distortion FIG. 2 gives an example of the distortion energy of a perceptual audio codec, and a corresponding workload measure, where a non-linear recursion has been used to calculate the workload. It can be observed that the workload shows high deviations over time and is dependent on the input material characteristics.

High perceptual entropy or high distortion energy indicates that a signal is psychoacoustically hard to code at a limited bitrate, and audible artifacts in the lowband are likely to appear. In this case the crossover frequency control module shall signal to use a lower crossover frequency in order to make it easier for the perceptual audio encoder to cope with the given signal. Concurrently, low perceptual entropy or low distortion energy indicates an easy-to-code signal. Thus the crossover frequency shall be chosen higher in order to allow a wider frequency range for the low band, thereby reducing artifacts that are likely to be introduced in the highband due to the limited capabilities of any existing HFR method. Both approaches also allow usage of an analysis-by-synthesis approach by re-encoding the current frame if an adjustment of the crossover frequency has been signaled in the analysis stage. However, since overlapping transforms are used in most state-of-the-art audio codecs, the performance of the system may be improved by applying a smoothing of the analysis input parameters over time, in order to avoid too frequent switching of the crossover frequency, which could cause blocking effects. If the actual implementation does not need to be optimized in terms of processing delay, the detection algorithm can be further improved by using a larger look-ahead in time, offering the possibility to find points in time where shifts can be done with a minimum of switching artifacts. Non-realtime applications represent a special case of tis, where the entire file to be encoded can be analyzed, if desired.

Figure 3:
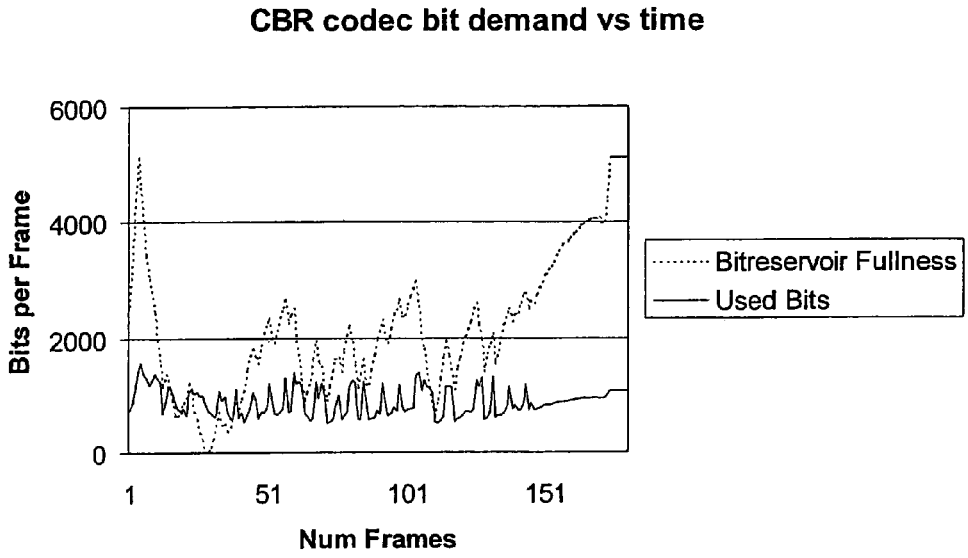
FIG. 3 is a graph that illustrates short time bit-demand variations of a constant bit rate codec.

In the case of a constant bit rate (CBR) audio codec, a short time bit-demand variation analysis may be used as an additional input parameter in the crossover decision: State-of-the-art audio encoders such as MPEG Layer-3 or MPEG-2 AAC use a bit reservoir technique in order to compensate for short time peak bit-demand deviations from the average number of available bits per frame. The fullness of such a bit reservoir indicates whether the core encoder is able to cope well with an upcoming difficult-to-encode frame or not. A practical example of the number of used bits per frame, and the bit reservoir fullness over time is given in FIG. 3. Thus, if the bit reservoir fullness is high, the core encoder will be able to handle a difficult frame and there is no need to choose a lower crossover frequency. Concurrently, if the bit reservoir fullness is low, the resulting audio quality may be substantially improved in the following frames by lowering the crossover frequency, in order to reduce the core encoder bit demand, such that the bit reservoir can be filled up due to the smaller frequency range that has to be encoded. Again, a large look-ahead can improve the detection method since the behavior of the bit reservoir fullness may be predicted well in advance.

Figure 4:
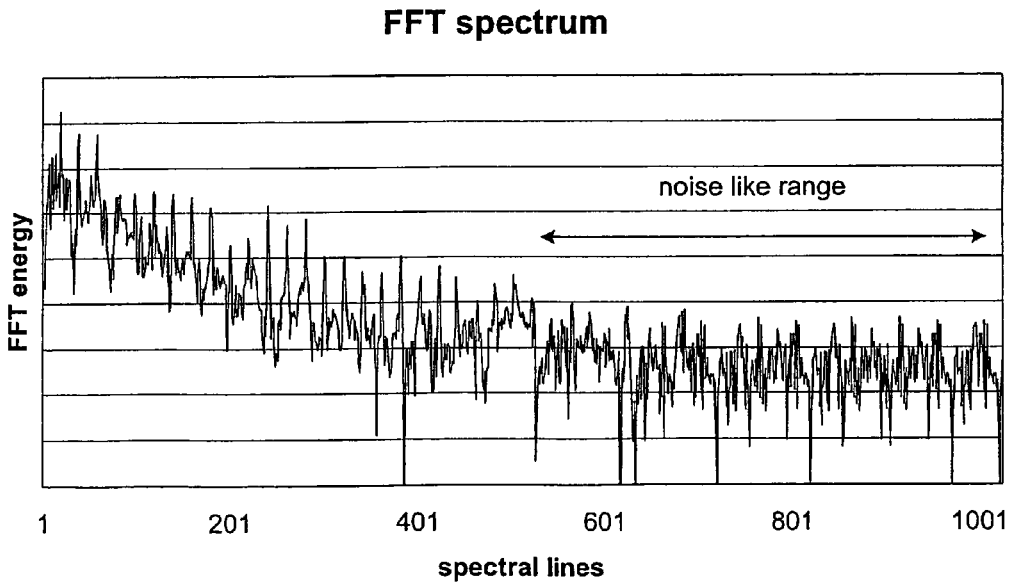
FIG. 4 is a graph that illustrates division of a signal into tonal and noise-like frequency ranges.

Besides the encoding difficulty of the currant frame, another important parameter to base the choice of the crossover frequency on is described as follows: A large number of audio signals such as speech or some musical instruments show the property that the spectral range can be divided into a pitched or tonal range and a noise-like range. FIG. 4 shows the spectrum of an audio input signal where this property is clearly evident. Using tonality and/or noise analysis methods in the spectral domain, two ranges may be detected, which can be classified as tonal and noise-like respectively. The tonality can be calculated as given for example in the AAC-standard [ISO/IEC 13818-7:1997(E), pp. 96–98, section B.2.1.4 "Steps in threshold calculation"]. Other well-known tonality or noise detection algorithms such as spectral flatness measure are also suited for the purpose. Thus the crossover frequency between these ranges is used as the crossover frequency in the context of the present invention in order to better separate the tonal and noise like spectral range and feed them separately to the core encoder, respectively the HFR method. Hence the overall audio quality of the combined codec system can be substantially improved in such cases.

Clearly, the above methods are applicable to double-ended and single-ended HFR-systems alike. In the later case, only a lowband of varying bandwidth, encoded by the core codec is transmitted The HFR decoder then extrapolates an envelope from the lowband cutoff frequency and upwards. Furthermore, the present invention is applicable to systems where the highband is generated by arbitrary methods different to the one that is used for coding of the lowband.

Adapting the HFR start frequency to the varying bandwidth of the lowband signal would be a very tedious task when applying conventional transposition methods such as frequency translation. Those methods generally involve filtering of the lowband signal to extract a lowpass or bandpass signal that subsequently is modulated in the time domain, causing a frequency shift. Thus, an adaptation would incorporate switching of lowpass or bandpass filters and changes in the modulation frequency. Furthermore, a change of filter causes discontinuities in the output signal, which impels the use of windowing techniques. However, in a filterbank-based system, the filtering is automatically achieved by extraction of subband signals from a set of consecutive filterbands. An equivalent to the time domain modulation is then obtained by means of repatching of the extracted subband signals within the filterbank. The repatching is easily adapted to the varying crossover frequency, and the aforementioned windowing is inherent in the subband domain, so the change of translation parameters is achieved at little additional complexity.

Figure 5:
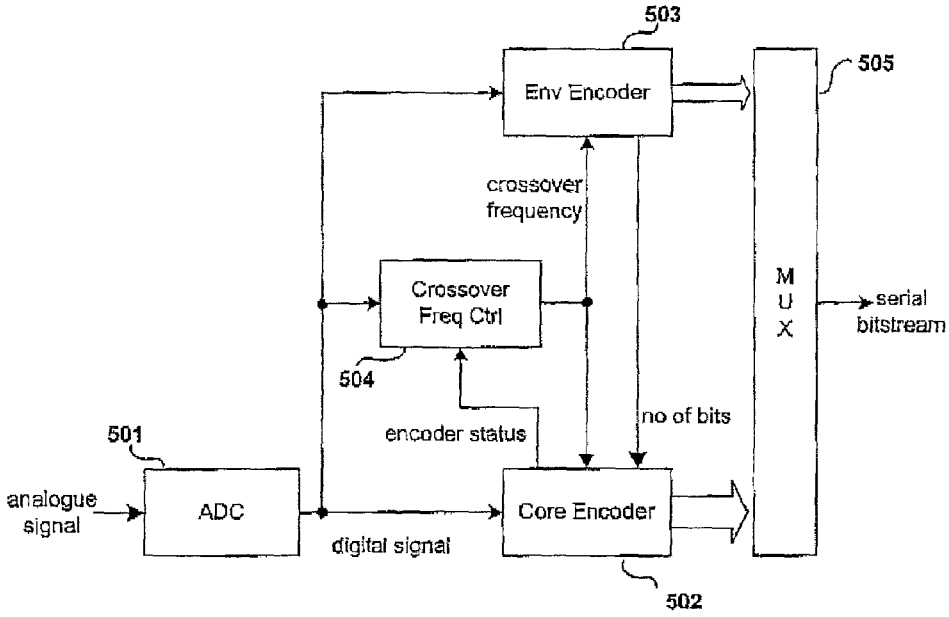
FIG. 5 is a block diagram of an HFR-based encoder, enhanced by a crossover frequency control module.

FIG. 5 shows an example of the encoder side of an HFR-based codec, enhanced according to the present invention. The analogue input signal is fed to an A/D-converter 501, forming a digital signal. The digital audio signal is fed to a core encoder 502, where source coding is performed. In addition, the digital signal is fed to an HFR envelope encoder 503. The output of the HFR envelope encoder represents the envelope data covering the highband 102 starting at the crossover frequency 103 as illustrated in FIG. 1. The number of bits that is needed for the envelope data in the envelope encoder is passed to the core encoder in order to be subtracted from the total available bits for a given frame. The core encoder will then encode the remaining lowband frequency range up to the crossover frequency. As taught by the present invention, a crossover frequency control module 504 is added to the encoder. A time- and/or frequency-domain representation of the input signal, as well as core codec status signals is fed to the crossover frequency control module. The output of the module 504, in form of the optimum choice of the crossover frequency, is fed to core and envelope encoders in order to signal the frequency ranges that shall be encoded. The frequency range for each of the two coding schemes is also encoded, for example by an efficient table lookup scheme. If the frequency range between two subsequent frames does not change, this can be signaled by one single bit in order to keep the bitrate overhead as small as possible. Hence the frequency ranges do not have to be transmitted explicitly in every frame. The encoded data of both encoders is then fed to the multiplexer, forming a serial bit stream that is transmitted or stored.

Figure 6:
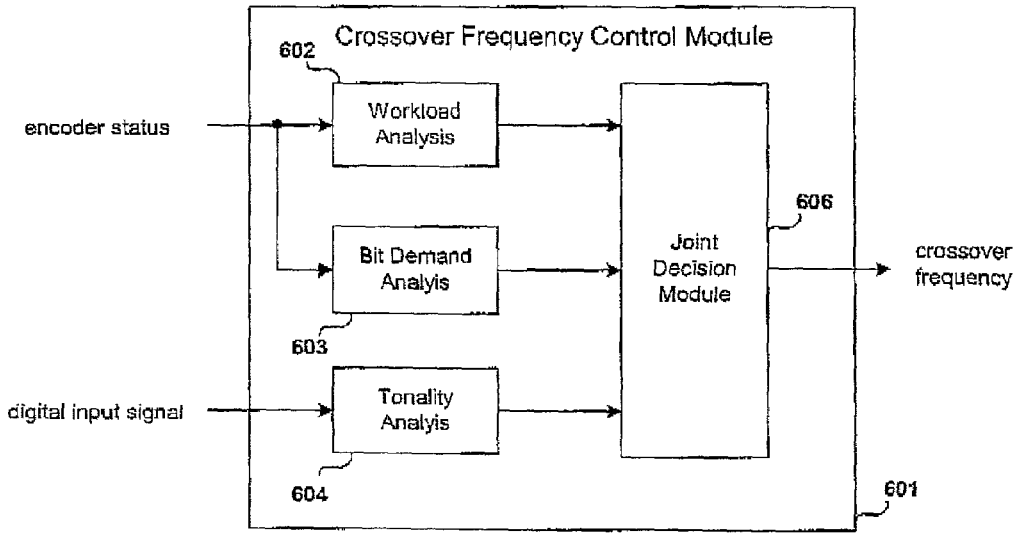
FIG. 6 is a block diagram, which illustrates the crossover frequency control module in detail.

FIG. 6 gives an example of subsystems within the crossover frequency control module 504, and 601 respectively. An encoder workload measure analysis module 602 explores how difficult the current frame is to code for the core encoder, using for example the perceptual entropy or the distortion energy approach as described above. Provided that the core codec employs a bit reservoir, a buffer fullness analysis module may be includes. The buffer fullness analysis module is shown as bit demand module 63 in FIG. 6. A tonality analysis module, 604, signals a target crossover frequency corresponding to the tonal/noise transition frequency when applicable. All input parameters to the joint decision module 606 are combined and balanced according to the actual implementation of the used core- and HFR-codecs when calculating the crossover frequency to use, in order to obtain the maximum overall performance.

Figure 7:
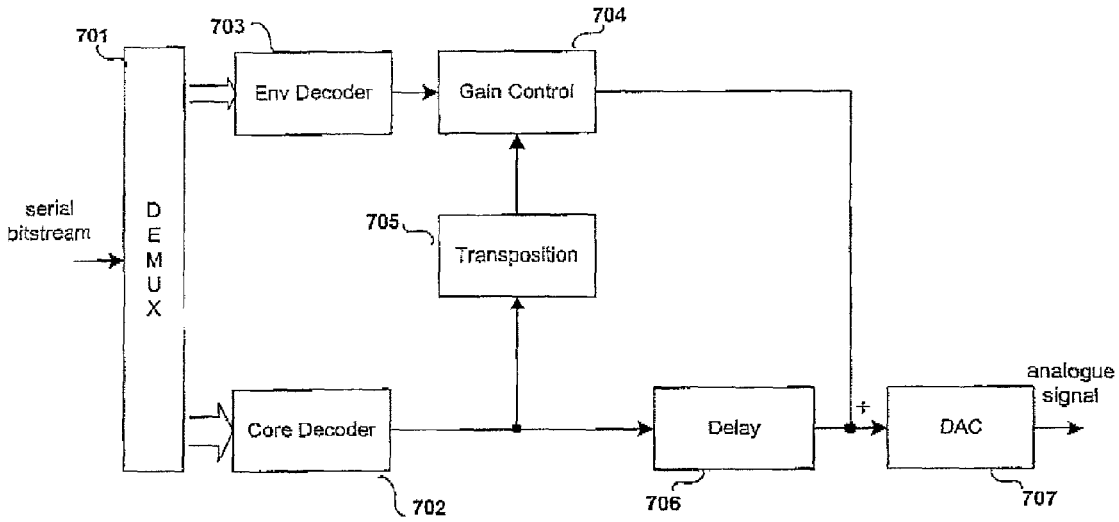
FIG. 7 is a block diagram of the corresponding HFR-based decoder.

The corresponding decoder side is shown in FIG. 7 The demultiplexer 701 separates the bitstream signals into core codec data, which is fed to the core decoder 702, envelope data, which is fed to the HFR envelope decoder 703. The core decoder produces a signal covering the lowband frequency range. Similarly, the HFR envelope decoder decodes the data into a representation of the spectral envelope for the highband frequency range. The decoded envelope data is then fed to the gain control module 704. The low band signal from the core decoder is routed to the transposition module 705, which, based on the crossover frequency, generates a replicated highband signal from the lowband. The highband signal is fed to the gain control module in order to adjust the highband spectral envelope to that of the transmitted envelope. The output is thus an envelope adjusted highband audio signal. This signal is added to the output from the delay unit 706, which is fed with Me lowband audio signal whereas the delay compensates for the processing time of the highband signal, Finally, the obtained digital wideband signal is converted to an analogue audio signal in the D/A-converter 707.

The invention claimed is:

1. An apparatus for encoding an audio signal to obtain an encoded audio signal to be used by a decoder having a high-frequency reconstruction module for performing a high-frequency reconstruction for a frequency range above a crossover frequency, the apparatus comprising:

a core encoder for encoding a lower frequency band of the audio signal up to the crossover frequency, the core encoder having a variable crossover frequency being controllable with respect to the variable crossover frequency, and operable on a block-wise frame by frame basis; and a crossover frequency control module for estimating, dependent on at least one of a measure of the degree of difficulty for encoding the audio signal by the core encoder and a border between a tonal and a noise-like frequency range of the audio signal, the crossover frequency to be selected by the core encoder for a frame of a series of subsequent frames, so that the crossover frequency is variable adaptively over time for the series of subsequent frames, the crossover frequency control module being adapted to control the core encoder with respect to the crossover frequency.

2. The apparatus according to claim 1, wherein a measure of a high degree of difficulty lowers the crossover frequency, and a measure of a low degree of difficulty increases the crossover frequency.

3. The apparatus according to claim 1, wherein said measure is based on a perceptual entropy of the audio signal.

4. The apparatus according to claim 1, wherein the measure is based on a distortion energy after coding with said core encoder.

5. The apparatus according to claim 1, wherein the measure is based on a status of a bit-reservoir associated with the core encoder.

6. The apparatus according to claim 1, wherein any combination of a perceptual entropy of the audio signal, a distortion energy after coding with the core encoder, and a status of a bit-reservoir associated with the core encoder is used to obtain the crossover frequency to be selected by the core encoder for a frame.

7. A method for encoding an audio signal to obtain an encoded audio signal to be used when decoding using a high-frequency reconstruction step for performing a high-frequency reconstruction for a frequency range above a crossover frequency, the method comprising:

core encoding a lower frequency band of the audio signal up to the crossover frequency, wherein the crossover frequency is variable, the core encoding taking place on a block-wise frame by frame basis; and estimating, dependent on a measure of the degree of difficulty for encoding the audio signal in the core-encoding step and/or dependent on a border between a tonal and a noise-like frequency range of the audio signal, a crossover frequency to be selected in the core-encoding step for a frame of a series of subsequent frames so that the crossover frequency is varied adaptively over time for the series of subsequent frames.

8. An apparatus for decoding an encoded audio signal, the encoded audio signal having been encoded using a variable crossover frequency, the encoded audio signal including an information on a crossover frequency being variable adaptively over time, the apparatus for decoding comprising:

a bitstream demultiplexer for extracting core decoder data, envelope data and the information on the variable crossover frequency;

a core decoder for receiving the core decoder data from the bitstream demultiplexer and for outputting lowband data having a timely varying crossover frequency;

a high-frequency regeneration envelope decoder for receiving the envelope data from the bitstream demultiplexer and for producing a spectral envelope output;

a transposition module for receiving the information on the variable crossover frequency and for generating a replicated highband signal from the lowband data based on the information on the variable crossover frequency;

a gain control module responsive to the high-frequency regeneration envelope decoder for adjusting the replicated highband signal to a spectral envelope output by the high-frequency regeneration envelope decoder to obtain an envelope adjusted highband signal; and an adder for adding a delayed version of the lowband data and the envelope adjusted highband signal to obtain a digital wideband signal.

9. A method for decoding an encoded audio signal, the encoded audio signal having been encoded using a variable crossover frequency, the encoded audio signal including an information on a crossover frequency being variable adaptively over time, the method for decoding comprising:

extracting core decoder data, envelope data and the information on the variable crossover frequency from the encoded audio signal;

receiving the core decoder data from a bitstream demultiplexer and outputting lowband data having a timely varying crossover frequency by means of a core decoder;

receiving the envelope data and producing a spectral envelope output by means of a high-frequency regeneration envelope decoder;

receiving the information on the variable crossover frequency and generating a replicated highband signal from the lowband data based on the information on the variable crossover frequency by means of a transposition module;

adjusting the replicated highband signal to a spectral envelope output by the high-frequency regeneration envelope decoder to obtain an envelope adjusted highband signal, by means of a gain control module; and adding a delayed version of the lowband data and the envelope adjusted highband signal to obtain a digital wideband signal.

* * * * *